US010739051B2

(12) United States Patent
Parker et al.

(10) Patent No.: US 10,739,051 B2
(45) **Date of Patent: *Aug. 11, 2020**

(54) HOSE FREE SENSOR SYSTEM FOR REFRIGERANT UNIT

(71) Applicant: Parker-Hannifin Corporation, Cleveland, OH (US)

(72) Inventors: Christian D. Parker, Washington, MO (US); Timothy A. Plassmeyer, Union, MO (US); James D. Ruether, Union, MO (US); Jason T. Dunn, Minneapolis, MN (US); Shawn D. Ellis, Golden Valley, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/357,511

(22) Filed: Mar. 19, 2019

(65) Prior Publication Data

US 2019/0212046 A1 Jul. 11, 2019

Related U.S. Application Data

(63) Continuation of application No. 14/913,834, filed as application No. PCT/US2015/011900 on Jan. 19, 2015, now Pat. No. 10,281,183.

(Continued)

(51) Int. Cl.
*F25B 49/00* (2006.01)

(52) U.S. Cl.
CPC ..... *F25B 49/00* (2013.01); *F25B 2700/19* (2013.01); *F25B 2700/21* (2013.01)

(58) Field of Classification Search
CPC ... F25B 49/00; F25B 2700/21; F25B 2700/19
See application file for complete search history.

(56) References Cited

U.S. PATENT DOCUMENTS 2,561,864 A 1/1947 Hollywood
4,114,448 A * 9/1978 Merritt ..... G01D 3/02 374/112

(Continued)

FOREIGN PATENT DOCUMENTS

DE 20 2008 000 837 6/2008
EP 2 309 212 A1 4/2011

OTHER PUBLICATIONS

International Search report and Written Opinion for corresponding International Application No. PCT/US2015/011900, dated Apr. 24, 2015.

*Primary Examiner* — Kun Kai Ma
(74) *Attorney, Agent, or Firm* — Renner, Otto, Boisselle & Sklar, LLP

(57) ABSTRACT

A hoseless sensor system for a refrigerant unit includes a plurality of hoseless sensors for sensing system parameters of the refrigerant unit, and a portable electronic device configured to receive the system parameters from the hoseless sensors and to calculate system conditions for the refrigerant based on the system parameters. The plurality of hoseless sensors includes a hoseless first pressure sensor and a hoseless second pressure sensor, and a hoseless first temperature sensor and a hoseless second temperature sensor. The temperature sensors may be temperature sensor clamps. Each temperature sensor clamp includes a clamping portion configured to clamp on a tube of the refrigerant unit, the clamping portion including a sensor element to measure temperature about the tube. The clamping portion further includes a plurality of clamping teeth, and adjacent clamping teeth interlock in an overlapping configuration when the clamp closes inward beyond a threshold point.

25 Claims, 11 Drawing Sheets

Related U.S. Application Data

(60) Provisional application No. 61/929,363, filed on Jan. 20, 2014.

(56) References Cited

U.S. PATENT DOCUMENTS 5,311,745 A * 5/1994 Lockhart ..... G01L 19/083 62/127
5,317,903 A * 6/1994 McClelland ..... F25B 45/00 62/149
D350,892 S * 9/1994 Sorensen ..... D8/395
6,056,282 A * 5/2000 Desmarais ..... B25B 5/003 269/152
6,334,320 B1 * 1/2002 Brown ..... F25B 41/003 62/149
6,708,587 B1 3/2004 Noniewicz et al.
6,799,756 B2 10/2004 Degen
7,234,313 B2 6/2007 Bell et al.
7,685,882 B1 3/2010 Ward
8,746,971 B2 * 6/2014 Alfano ..... G01D 11/24 374/141
8,991,254 B2 * 3/2015 Raguenet ..... B25B 5/06 73/587
9,448,140 B2 9/2016 Ulrich et al.
9,810,250 B2 11/2017 Penzes
9,958,190 B2 5/2018 West
2002/0040280 A1 * 4/2002 Morgan ..... B60H 1/00978 702/114
2003/0182950 A1 * 10/2003 Mei ..... F25B 49/005 62/129
2005/0005759 A1 1/2005 Dulaney et al.
2005/0098932 A1 * 5/2005 Panosian ..... B25B 5/003 269/37
2006/0090484 A1 * 5/2006 Bell ..... F25B 49/005 62/129
2007/0205296 A1 9/2007 Bell et al.
2008/0066474 A1 3/2008 Porter et al.
2008/0077260 A1 * 3/2008 Porter ..... F25B 49/005 62/129
2008/0163629 A1 * 7/2008 Chen ..... G01K 13/00 62/129
2009/0024268 A1 * 1/2009 Eagan ..... G01M 17/00 701/31.4
2010/0162822 A1 7/2010 Ward
2012/0241123 A1 * 9/2012 Alfano ..... G01D 11/24 165/11.1
2013/0245965 A1 * 9/2013 Kane ..... G05B 23/0264 702/33
2013/0297225 A1 11/2013 Jeffers et al.
2015/0241316 A1 * 8/2015 Ulrich ..... F25B 45/00 340/626
2017/0100985 A1 4/2017 Johnson et al.
2018/0128529 A1 * 5/2018 Chen ..... F25B 45/00

* cited by examiner

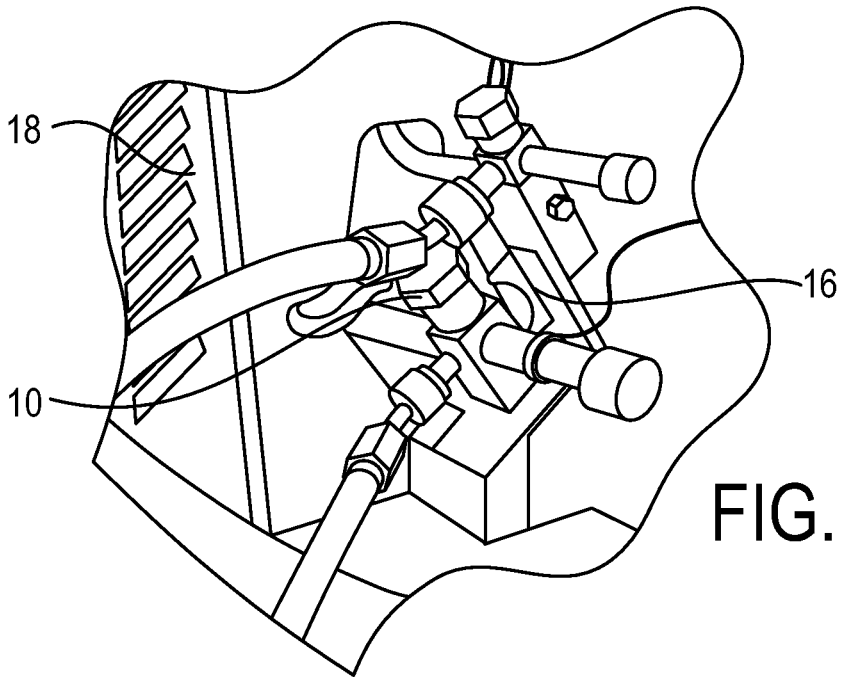
FIG. 3
FIG. 4
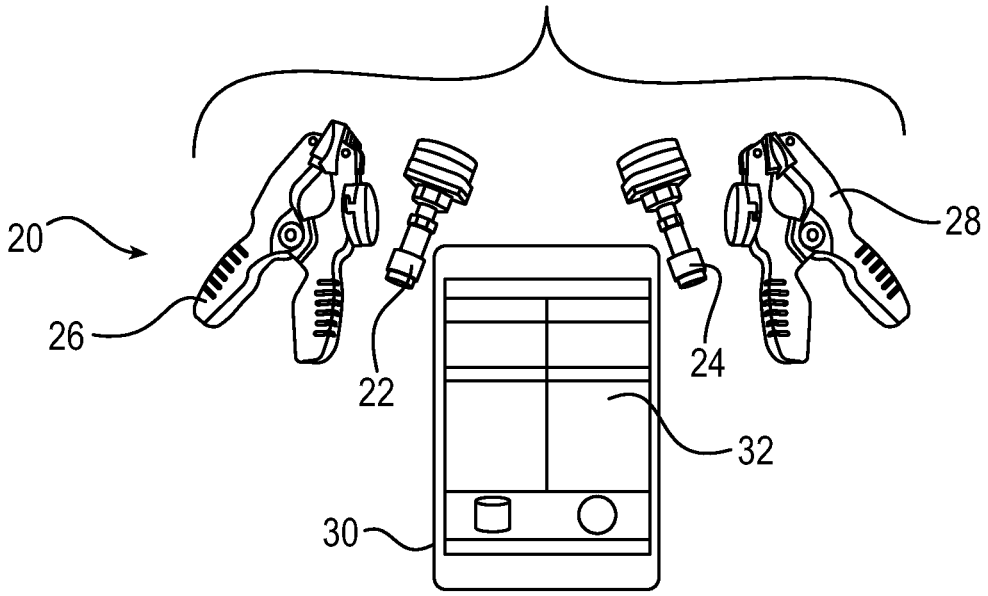

FIG. 5
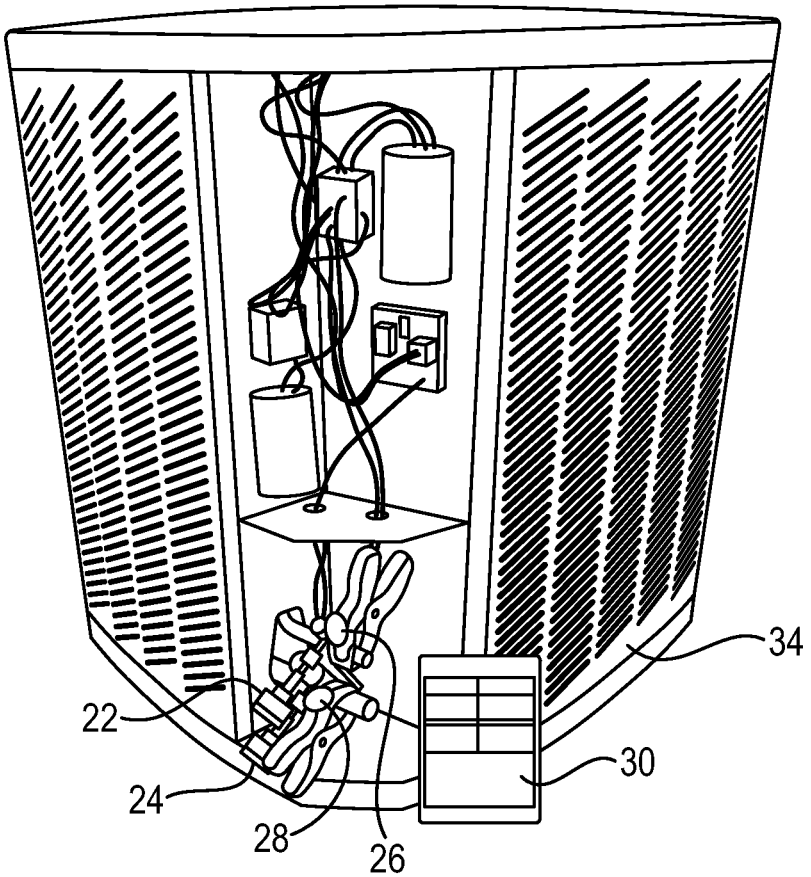
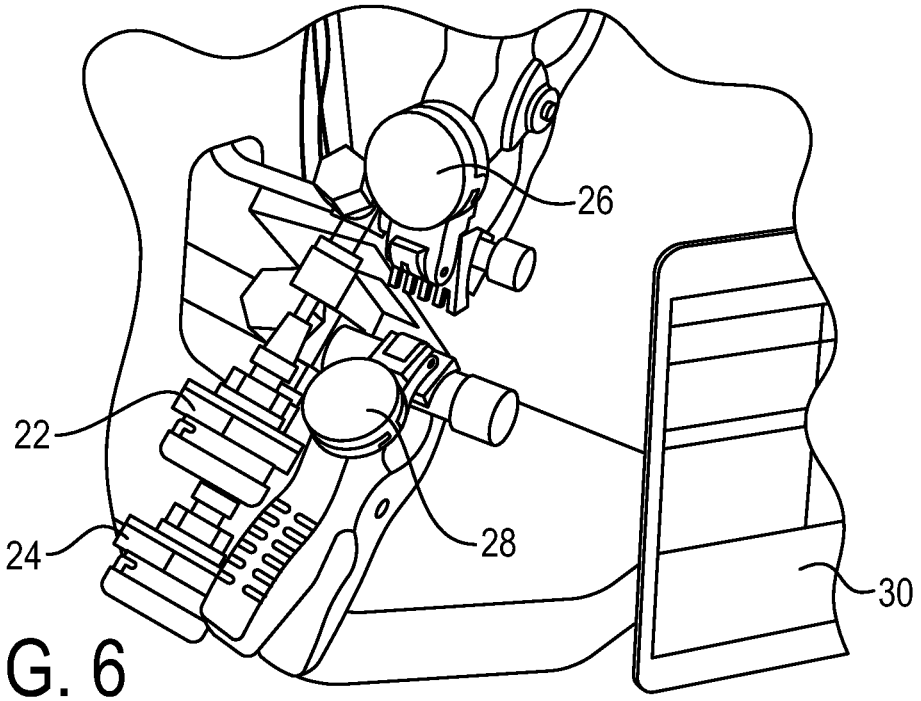
FIG. 6

FIG. 15A
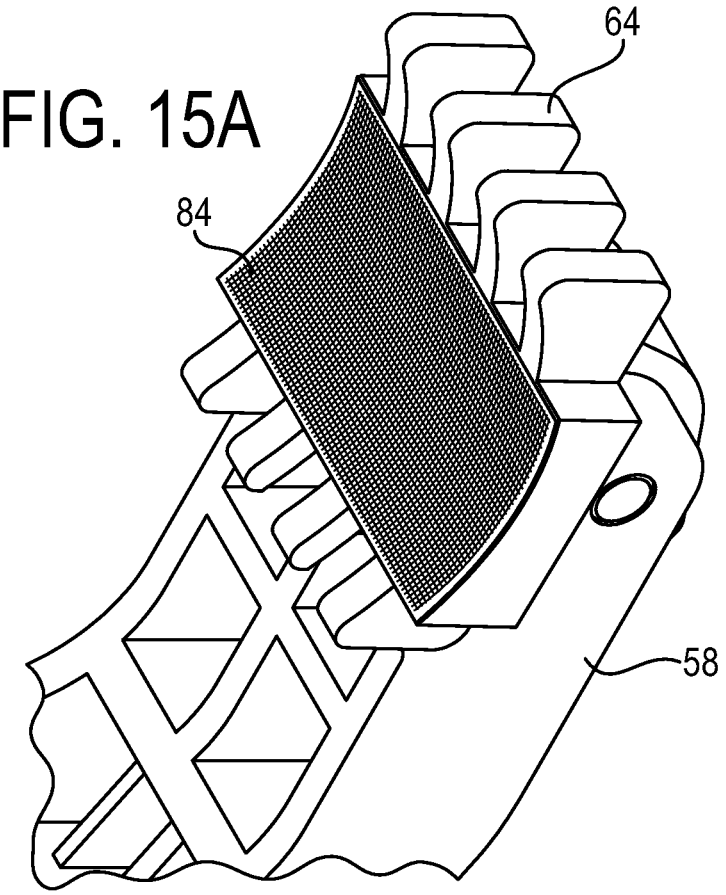
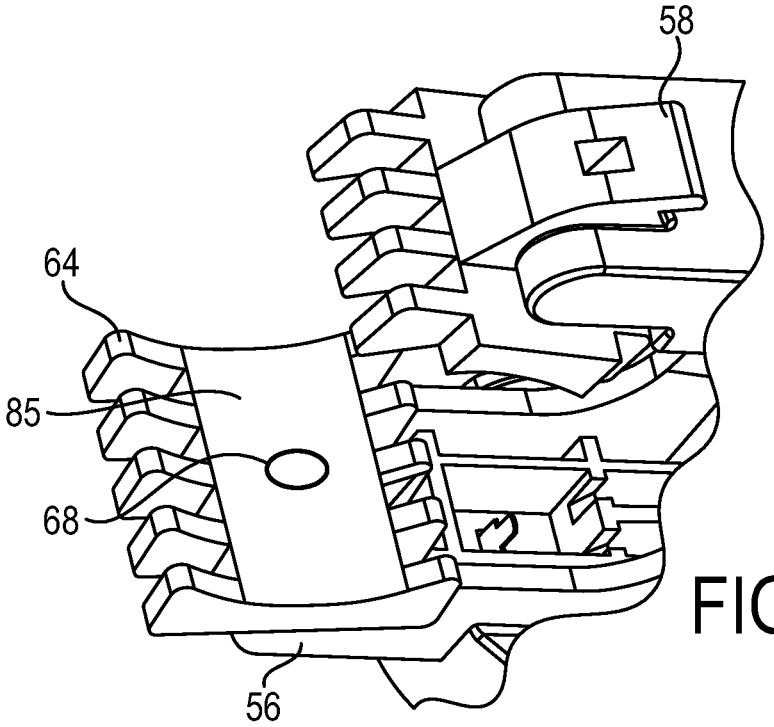
FIG. 15B

HOSE FREE SENSOR SYSTEM FOR REFRIGERANT UNIT

RELATED APPLICATION DATA

This application is a continuation of U.S. application Ser. No. 14/913,834 filed on Feb. 23, 2016, which is a national phase of International Application No. PCT/US2015/011900 filed Jan. 19, 2015 and published in the English language, which claims priority to U.S. provisional application No. 61/929,363, filed on Jan. 20, 2014.

FIELD OF THE INVENTION

The present invention is directed to enhanced sensor systems for refrigeration units for monitoring and collecting system conditions, such as superheat and subcooling.

BACKGROUND OF THE INVENTION

As used herein, the term "refrigerant unit" or "refrigeration unit" is employed as a generalized term that encompasses equipment broadly used in heating, ventilation, air conditioning and refrigeration (HVACR) systems. The HVACR markets have been served by manual, analog gauge sets for many decades. FIG. 1 depicts a conventional gauge set used for monitoring and collecting system conditions of a refrigerant unit such as pressure, which may then be used to calculate system parameters such as superheat and subcooling. The gauge set permits a service technician to see inside the system to help diagnose and repair faulty systems and components.

As seen in FIG. 1, a conventional gauge set 10 is an analog gauge set that uses a set of hoses 11 connected to a manifold with valves 12. There is a set of analog pressure gauges 14, typically a high side pressure gauge (often identified with a red color) and a low side pressure gauge (often identified with a blue color). The hoses are attached to the system via a flare quick connection (commonly referred to as an SAE connection) for both the low side and high side of the refrigeration unit or air conditioning system. The refrigerant pressure is transmitted via the hoses, through the manifold and up to the analog gauges, and the gauges display the pressure to the technician.

For the service technician to calculate superheat or subcooling, a temperature sensor is attached to the refrigeration unit to measure temperature of the refrigeration. This temperature sensor operates as a temperature meter that is manually attached to the outside of a refrigerant tube near the pressure port where the gauge set hoses are attached. FIGS. 2 and 3 (FIG. 3 being a more close-up view) depict the installation of the conventional gauge set 10 and temperature sensors 16 within an air conditioning unit 18. The temperature and pressure are then used by the technician to manually calculate superheat and subcooling. In particular, as is known in the art, there are established calculations by which superheat and subcooling are calculated based on the measured temperature and pressure parameters.

The conventional hose gauge system has significant deficiencies. The refrigerant travels through the length of the hoses to the analog or digital gauges at the manifold to display pressure. The refrigerant can be in the form of vapor or liquid, with common hose sizes being 5' or 6' in length. Under current environmental regulations, refrigerant in the hoses must be collected and reclaimed, and not just released into the environment. A quick connect coupling is available on the market to eliminate refrigerant "blow off" (emptying the refrigeration hoses after system inspection). The coupling is attached to the end of the hoses and essentially traps the refrigerant in the hoses after removing them from the system. The disadvantage of using this form of coupling is that the analog gauge set can only be used for one type of system, i.e., the system refrigerant must be the same type as the trapped refrigerant inside of the hoses or refrigerant and oil contamination will occur.

Relatedly, cross contamination between refrigerant systems must be avoided. Common practice today is that a service technician needs to have several analog gauge sets for particular refrigerants. For example, a technician may have a first gauge set for R-134a, a second gauge set for R-410, and a third gauge set for R-404a refrigerants. By having multiple analog gauge sets, a technician must be careful to avoid cross contamination among the gauge sets. Cross contamination can cause damage to the gauge set hoses and also reduce system performance, particularly on small systems due to incompatibilities among different refrigerant and oils.

The hoses also are bulky and therefore must be carried and transported. The efforts and inconvenience of transport are increased by the need for multiple gauge sets. Weight and flexibility further are significant for service technicians due to the fact that they are often climbing on ladders and carrying tools to roofs to service roof-top condensing units for refrigeration or air conditioners. Conventional analog gauge sets also require the technician to stand next to the gauge set to read pressure, or two technicians with two-way radios or equivalent mobile devices may need to report measurements to each other. The close distance requirements of conventional analog gauge sets provides yet another deficiency of such systems.

SUMMARY OF THE INVENTION

There is a need in the art for an improved sensor system for refrigeration units for monitoring and collecting system conditions such as superheat and subcooling. The described invention is a hoseless system of individual hose-free sensors that are installed on a refrigeration or air conditioning system. Sensor information may be transmitted wirelessly to a remote device, such as a portable electronic device (e.g., tablet computer, laptop computer, smartphone, or the like). The portable electronic device may have installed a software or program application that receives the sensor information and calculates automatically system conditions, such as for example superheat and subcooling.

The sensors may include high side and low side pressure and temperature, which permit installation into the refrigeration unit without hoses to collect system parameters, such as temperature and pressure. The system parameter measurements are transmitted from the sensors to a mobile portable electronic device via a wireless communication. The measurements are used by the mobile device via executing the program application to calculate system conditions, such as for example superheat and subcooling. The invention thus permits service technicians to diagnose and repair systems or components, without the drawbacks of conventional analog hose gauge sets.

In accordance with the above, an aspect of the invention is a sensor system for a refrigerant unit. In exemplary embodiments, the sensor system includes a plurality of hoseless sensors for sensing system parameters of the refrigerant unit, and a portable electronic device configured to receive the system parameters from the hoseless sensors and to calculate system conditions for the refrigerant based on the system parameters. The plurality of hoseless sensors may include a hoseless first pressure sensor and a hoseless second pressure sensor, and a hoseless and wireless first temperature sensor and a hoseless and wireless second temperature sensor. The first pressure sensor and first temperature sensor may be sensors for a high side of the refrigerant system, and the second pressure sensor and the second temperature sensor may be sensors for a low side of the refrigerant system. The system conditions calculated by the portable electronic device may include superheat and subcooling for the refrigerant system.

Another aspect of the invention is an enhanced temperature sensor clamp for use as the temperature sensors in the described sensor system for sensing temperature in the refrigerant unit. In exemplary embodiments, the temperature sensor clamp includes a clamping portion configured to clamp on a tube of the refrigerant unit, the clamping portion including a sensor element to measure temperature about the tube. The clamping portion further includes a plurality of clamping teeth, and adjacent clamping teeth interlock in an overlapping configuration when the clamp closes inward beyond a threshold point. The clamping portion further includes a perforated gripping portion for gripping the tube of the refrigerant unit, the gripping portion including a grating. When the clamping portion clamps the tube, the grating scores the tube to clean and grip the tube. The temperature sensor clamp further includes a handle and integrated electronics incorporated into the handle. The integrated electronics, for example, may include a battery housing for a battery, a light emitting status indicator, wireless transmitter and/or a wireless interface pair button.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

BRIEF DESCRIPTION OF DRAWINGS

FIG. 3 depicts a close-up view of the installation of FIG. 2.

FIG. 4 depicts an exemplary hoseless sensor system for use in sensing parameters and determining system conditions in a refrigerant unit.

FIG. 5 depicts the installation of the hoseless sensor system of FIG. 4 within an air conditioning unit.

FIG. 6 depicts a close-up view of the installation of FIG. 5.

FIG. 15A is a schematic diagram depicting an isometric close-up view of a lower clamp tip, including a perforated gripping pad.

FIG. 15B is a schematic diagram depicting an isometric close-up view of an upper clamp tip, including a gripping surface and incorporated sensing element.

DETAILED DESCRIPTION

Figure 1:
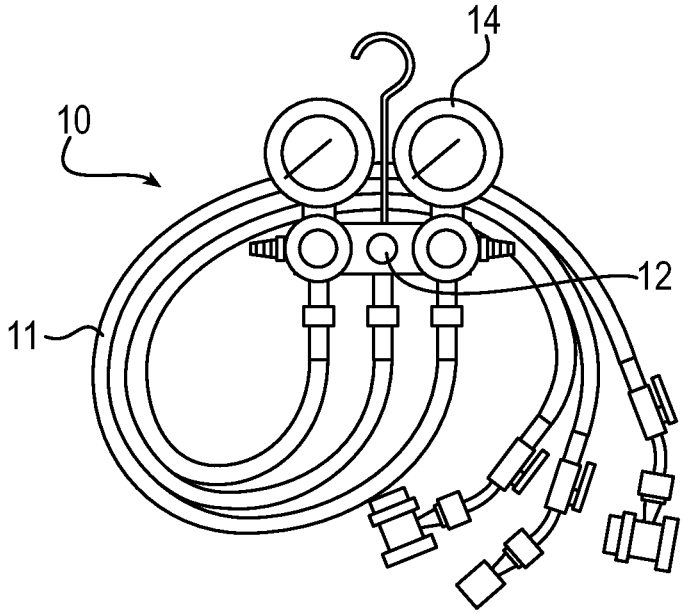
FIG. 1 depicts a conventional gauge set used for monitoring and collecting system parameters of a refrigerant unit.
Figure 2:
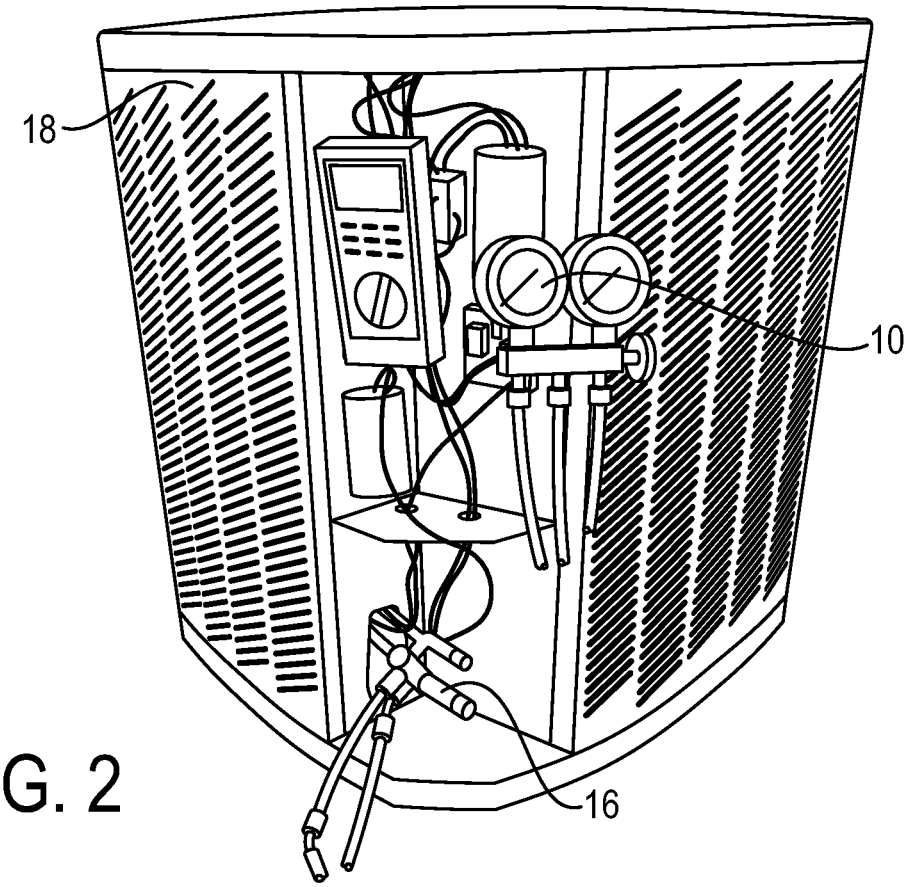
FIG. 2 depicts the installation of the conventional gauge set of FIG. 1 and a temperature sensor within an air conditioning unit.

Embodiments of the present invention will now be described with reference to the drawings, wherein like reference numerals are used to refer to like elements throughout. It will be understood that the figures are not necessarily to scale.

As referenced above, as used herein the term "refrigerant unit" or "refrigeration unit" is employed as a generalized term that encompasses equipment broadly used in heating, ventilation, air conditioning and refrigeration (HVACR) systems. Accordingly, it is understood that the present invention is not limited to usage in any particular type of device, and the term refrigerant unit or refrigeration unit is a generic term that encompasses all HVACR related and like devices in which the present invention may be employed.

FIG. 4 depicts an exemplary hoseless sensor system 20 for use in sensing parameters and determining system conditions in a refrigerant unit. In exemplary embodiments, the sensor system includes a plurality of hoseless sensors for sensing system parameters of the refrigerant unit, and a portable electronic device configured to receive the system parameters from the hoseless sensors and to calculate system conditions for the refrigerant unit based on the system parameters.

Referring to FIG. 4, in the sensor system 20 the plurality of hoseless sensors may include a hoseless first pressure sensor 22 and a hoseless second pressure sensor 24. The plurality of hoseless sensors further may include a hoseless first temperature sensor 26 and a hoseless second temperature sensor 28. The first pressure sensor 22 and first temperature sensor 26 may be sensors for a high side of the refrigerant system, and the second pressure sensor 24 and the second temperature sensor 28 may be sensors for the low side of the refrigerant system. The high side and low side sensors respectively may be color coded red and blue as is conventional. A portable electronic device 30 may calculate system conditions based on sensor parameters measured by the plurality of hoseless sensors. The portable electronic device may execute a software program application 32 to calculate system conditions, including superheat and subcooling for the refrigerant system. The portable electronic device 30 may be any suitable mobile device, such as, for example, a tablet computer, laptop computer, smartphone, or the like. The program application 32 may be a mobile application suitable for execution by such portable electronic devices.

The use of high side and low side pressure and temperature sensors permits a variety of system calculations to be performed by the portable electronic device 30 executing the program application 32. The measurements may be used to calculate system conditions, such as for example superheat and subcooling. The program application further may be executed to calculate a temperature differential ($\Delta T$) and pressure differential ($\Delta P$) based on measurements of the high side sensors relative to the low side sensors. $\Delta T$ and $\Delta P$ are useful indications of system performance. For example, $\Delta T$ may be employed as a measure of air coil performance and system capacity. As another example, a high $\Delta P$ may be indicative of clog in the system, such as for example at a filter or coil. $\Delta T$ and $\Delta P$ parameters are useful in a variety of trouble shooting determinations in evaluating system performance.

FIG. 5 depicts the installation of the hoseless sensor system of FIG. 4 within an air conditioning unit 34. FIG. 6 depicts a close-up view of the installation of FIG. 5. The sensor system of the present invention eliminates the need for hoses to measure system parameters. The pressure sensors 22 and 24 are installed by hand onto the system tube via a flare quick connection, such as for example a ¼" SAE connector or other suitable structure. The temperature sensors 26 and 28 may be configured as temperature sensor clamps also installed by hand. The temperature sensor clamps are installed by clamping on the outside of the refrigerant system tubes next to the pressure sensors to sense temperature of the refrigerant inside the tubes. The pressure and temperature sensors may be visually identified with color for low side (blue) and high side (red) of the refrigerant system as is conventional.

Figure 7:
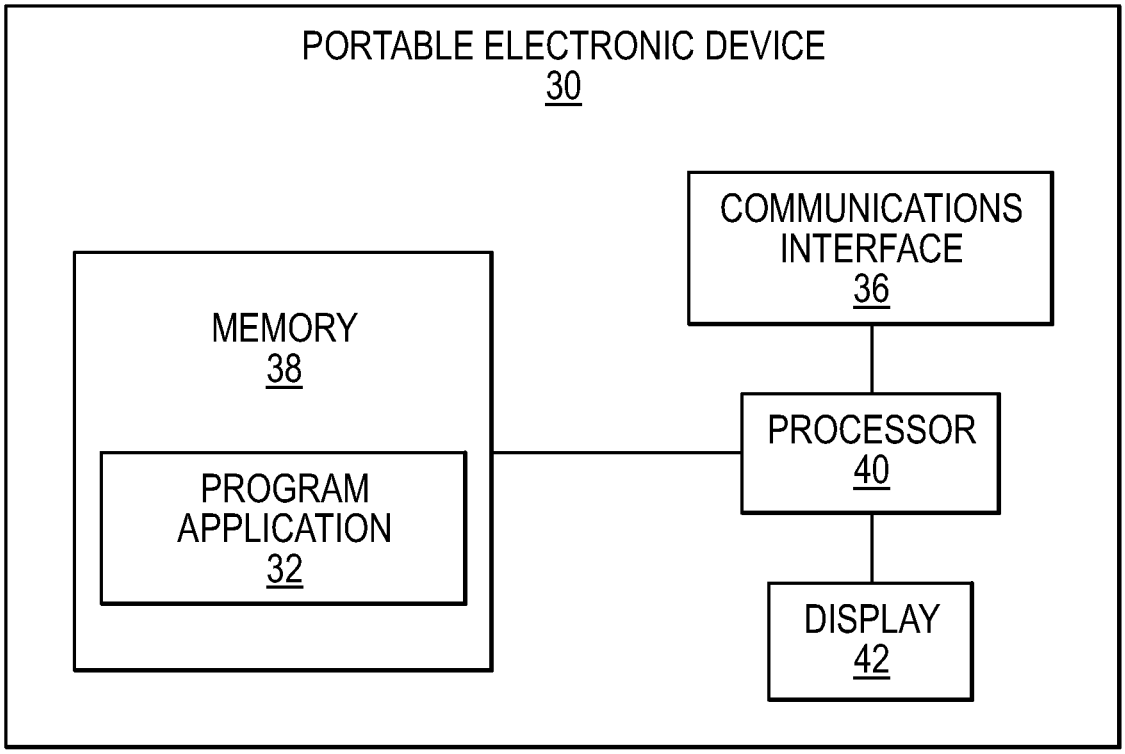
FIG. 7 is a schematic block diagram depicting operative portions of an exemplary portable electronic device for use in the sensor system.
Figure 8A:
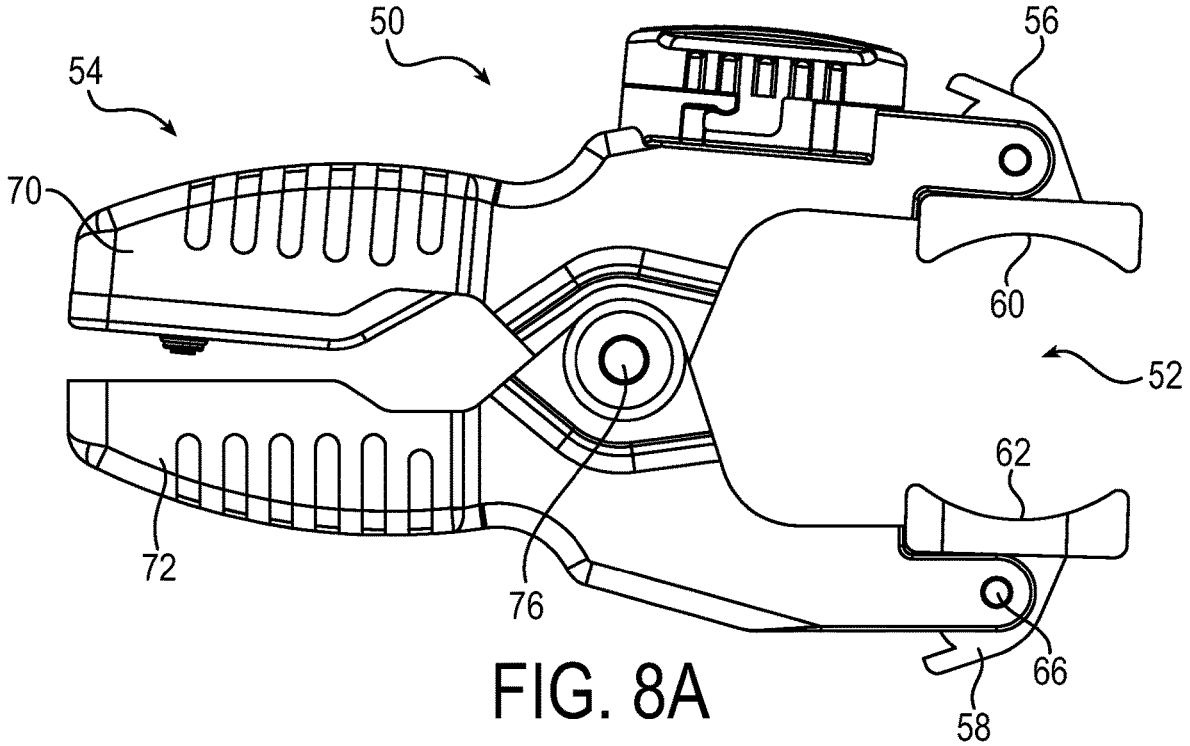
FIGS. 8A-B are schematic diagrams depicting side views of an exemplary temperature sensor clamp with the clamp open.
Figure 8B:
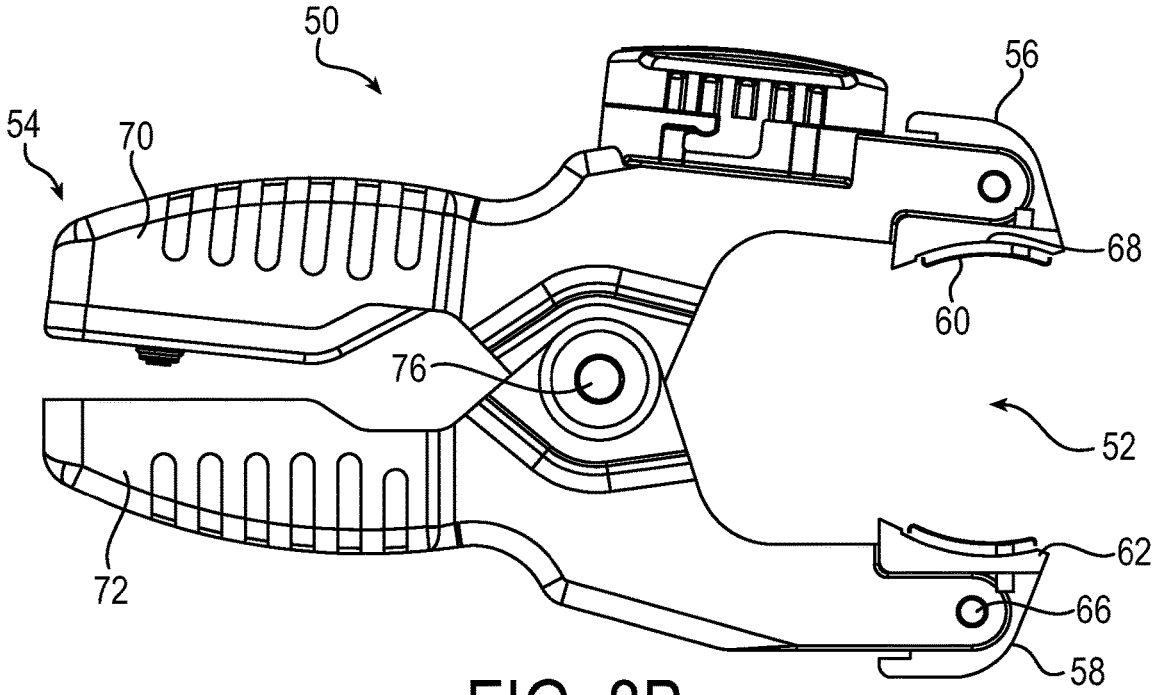
Figure 9A:
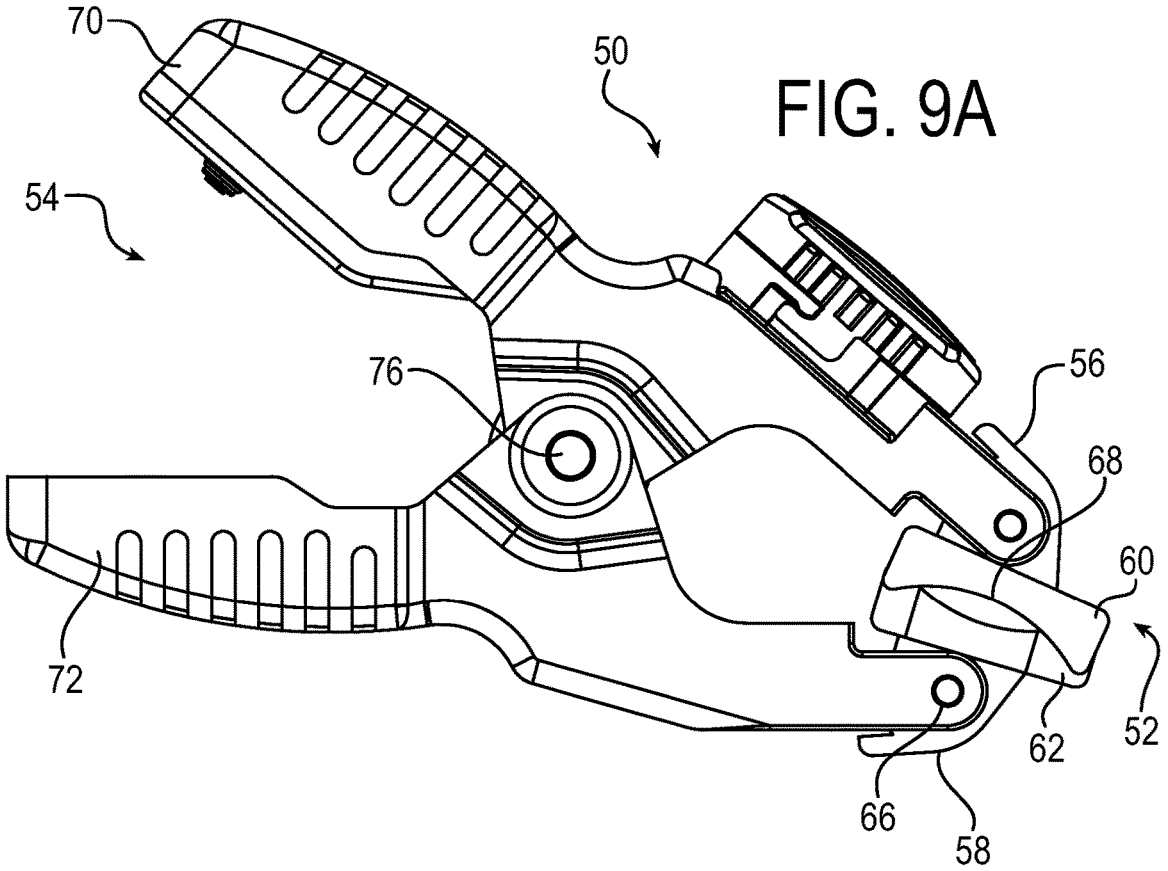
FIGS. 9A-B are schematic diagram depicting side views of the exemplary temperature sensor clamp of FIG. 8 with the clamp closed.
Figure 9B:
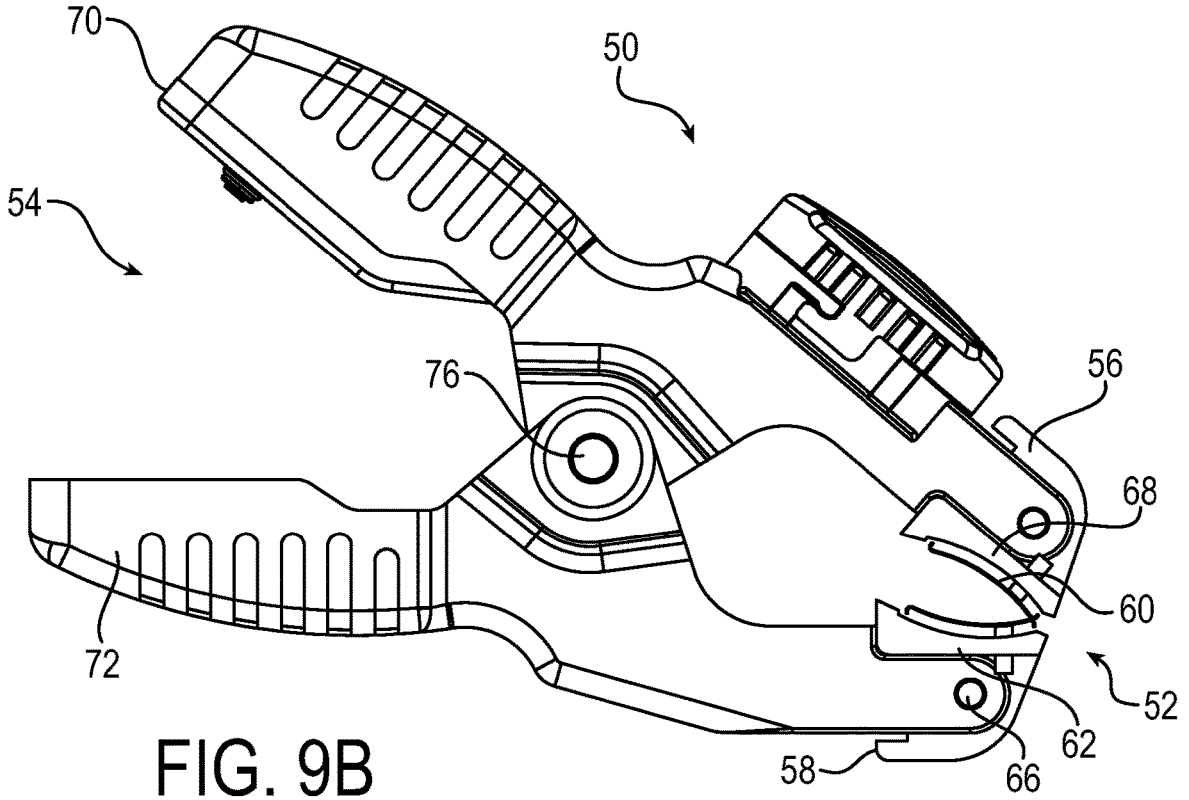
Figure 10:
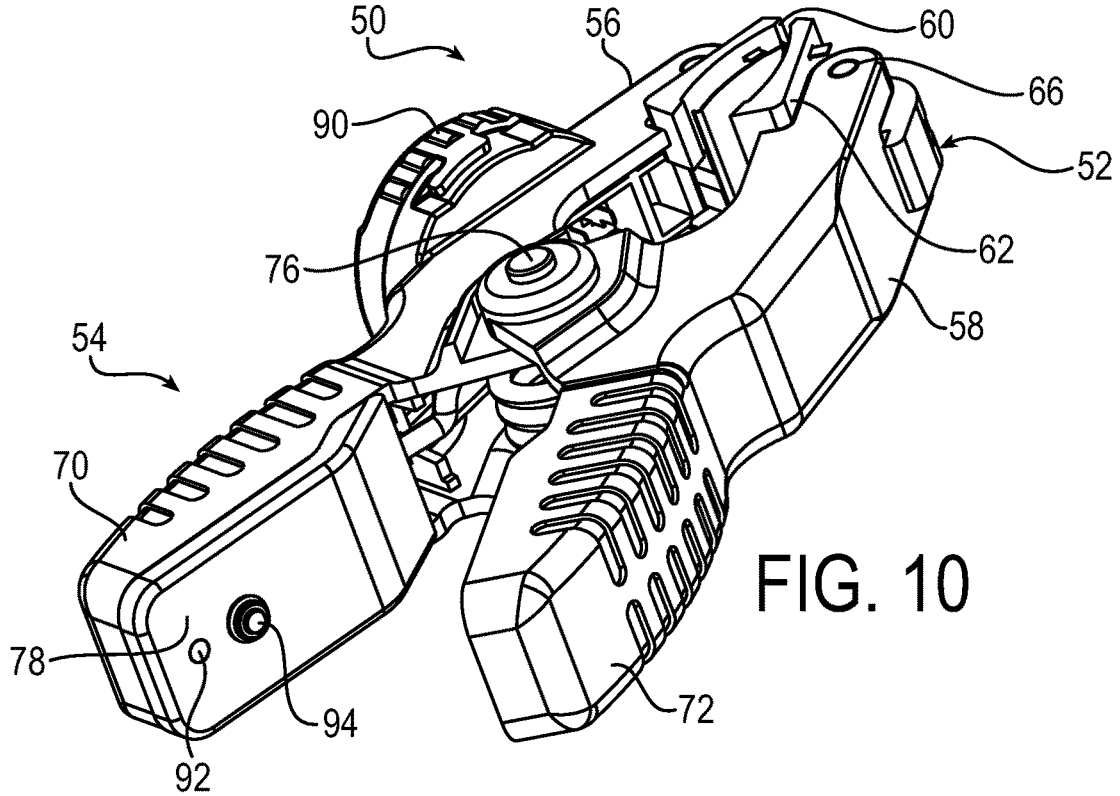
FIG. 10 is a schematic diagram depicting an isometric bottom view of the exemplary temperature sensor clamp of FIG. 9.

FIG. 7 is a schematic block diagram depicting operative portions of an exemplary portable electronic device 30. The portable electronic device 30 may include a communications interface 36 for wirelessly receiving the system parameters from the hoseless sensors. The communications interface may also include a wireless transmitting capability that can transmit information to the sensors, such as for example firmware updates or the like, or otherwise transmit data externally from the electronic device. The wireless communication may be performed over any suitable wireless interface, such as Bluetooth, Wi-Fi, cellular networks, or other suitable wireless technologies that are known in the art. As part of such wireless communication and interfacing, the communications interface 36 may include an auto-connect feature that automatically establishes a wireless connection for communication with the sensors based on specified criteria, such as for example range, readiness status or state, and/or other suitable criteria.

A memory 38, which may be any suitable non-transitory computer readable medium known in the art, stores the program application 32. The programming of such applications are known to those skilled in the programming art, so the precise program code is omitted here for convenience. A processor device 40 is configured to receive the sensor parameters via the communications interface 36, and to execute the program application 32 to calculate the system conditions based on the system parameters. The portable electronic device 30 further may include a display 42 for displaying pertinent sensor and system condition information to the technician.

The pressure and temperature sensors transmit pressure and temperature data to the portable electronic device preferably by a wireless communication. The executed program application performs a calculation to display real time system conditions, such as superheat and subcooling. The portable electronic device and related program application can support multiple wireless sensors and sensor types, including for example pressure and temperature sensors as described above, and additionally sensor types such as, for example, sensors for humidity, weight, current, vibration, and other parameters. The program application also allows the user to record and store the data in the device memory, and may include a graphing feature to aid in diagnosing the system. It will be appreciated that a variety of communications technologies may be employed to execute the program application and cooperate with the sensors. For example, the system may operate via a cellular network, WiFi network, or other external network. In certain locations, however, access to such networks may be limited (e.g., in basements, cellars, subway systems, and other enclosed, underground and remote areas). Accordingly, in exemplary embodiments the application may run solely over a localized interface with all requisite data being stored and processed locally on the portable electronic device 30.

The program application also may include a GPS feature and a "send" feature to allow the technician to pin where the job is, and to send the system data back to a service shop for analysis. The program application also may offer a refrigerant type selection to allow service technicians to use the sensor system across multiple different refrigerant systems, along with a calibration feature to offset the temperature and pressure display readings. The program application also permits the technician to save and send system data for further analysis. The program application also may use location services to inform a technician of the closest wholesaler and/or customer service contact information to order replacement parts for system repair. In this manner, enhanced product support can be provided.

The hoseless configuration of the present invention has significant advantages over conventional gauge sets. Because there are no hoses, the present invention minimizes refrigerant loss and difficulties associated with processing and reclaiming refrigerant trapped in hoses. The quick connect coupling of the pressure sensors eliminates the need for the refrigerant blow off to empty refrigeration hoses after system inspection. Also, without the need to reclaim trapped refrigerant, the hoseless system of the present invention can be used for multiple types of refrigerant systems. Relatedly, the invention eliminates cross contamination between systems by replacing multiple gauge sets with a sensor system that is useable across different refrigerant systems with otherwise incompatible refrigerants and oils. The program application permits the technician to select the proper refrigerant per system for current usage, and to change the selection for a different type of system.

In addition, because the present invention has a hoseless configuration, the present invention can be easily carried in a small case or separately. The overall weight of the hoseless configuration is approximately one fifth as light as conventional hose-containing gauge sets. The hoseless configuration, therefore, is more readily usable by service technicians when there is a need, for example, to climb on ladders and carry tools to service roof-top condensing units for refrigeration or air conditioners.

The wireless nature of the transmission of the sensor data to the portable electronic device permits the service technician the flexibility of walking around the different parts of the system while reading system conditions displayed on the portable electronic device with the program application. There is no need for the technician to stand next to the gauge set to read pressure, or to utilize two technicians with a two-way mobile radio system, as referenced above with respect to conventional hose gauge sets. The present invention also allows flexibility for adjusting system components while reading the real time data through the portable electronic device via the program application. The increased permissible distance also allows the technician to remove himself of herself from noise where the measurements are taken, such as for example a mechanical room in supermarkets where refrigeration compressors are located. In exemplary embodiments, a repeater or other suitable device may be employed to extend the range of communication.

In exemplary embodiments, the hoseless sensor system has enhanced temperature sensors. Each enhanced temperature sensor is configured as a temperature sensor clamp. In exemplary embodiments, the temperature sensor clamp includes a clamping portion configured to clamp on a tube of the refrigerant unit, the clamping portion including a sensor element to measure temperature about the tube. The clamping portion further includes a plurality of clamping teeth, and adjacent clamping teeth interlock in an overlapping configuration when the clamp closes inward beyond a threshold point. The clamping portion further includes a perforated gripping portion for gripping the tube of the refrigerant unit, the gripping portion including a grating. When the clamping portion clamps the tube, the grating scores the tube to clean and grip the tube. The temperature sensor clamp further includes a handle and integrated electronics incorporated into the handle. The integrated electronics, for example, may include a battery housing for a battery, a light emitting status indicator, and/or a wireless interface pair button.

Figure 11:
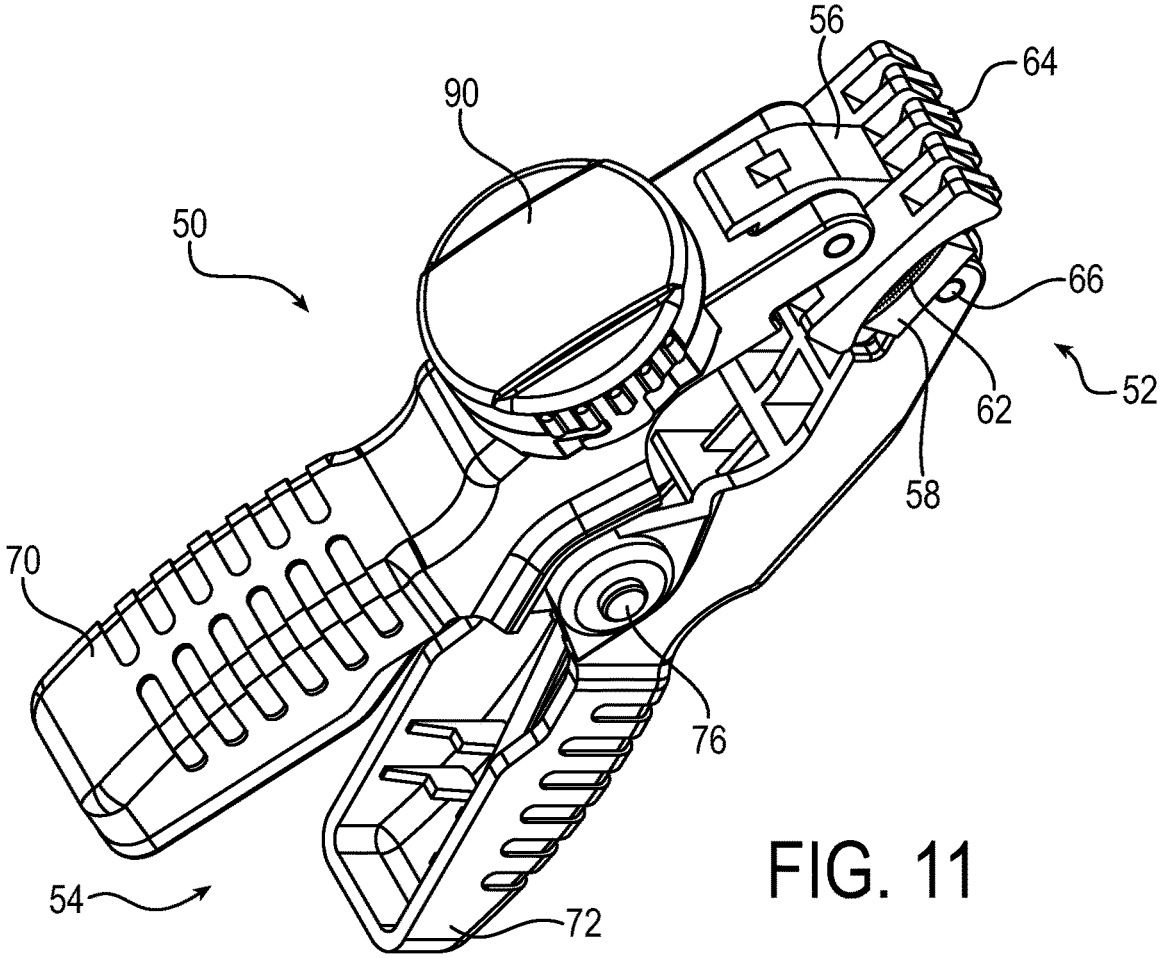
FIG. 11 is a schematic diagram depicting an isometric top view of the exemplary temperature sensor clamp of FIG. 9.

FIGS. 8-11 are schematic diagrams depicting various views of an exemplary temperature sensor clamp 50, including side views with the clamp open (FIGS. 8A-B), side views with the clamp closed (FIGS. 9A-B), an isometric bottom view (FIG. 10), and an isometric top view (FIG. 11.) The temperature sensor clamp 50 includes a clamping portion 52 constituting the tip of the temperature sensor clamp, and a handle portion 54. The clamping portion 52 includes an upper clamp tip 56 and a lower clamp tip 58, which respectively include an upper gripping portion 60 and a lower gripping portion 62. The upper gripping portion 62 includes an embedded temperature sensing element 68 for sensing temperature of a tube in a refrigerant unit. As best seen in FIG. 11 of this group of figures, the clamping portion further includes a plurality of clamping teeth 64, whose operation is described in more detail below. The upper and lower clamp tips 56 and 58 each may be rotatable about a clamp tip shaft 66, one each provided in the upper and lower portions of the clamping portion 52.

The handle portion 54 includes an upper handle portion 70 and a lower handle portion 72. The upper handle portion 70/upper clamp tip 56 are rotatable about the lower handle portion 72/lower clamp tip 58 via a center shaft 76. As further described below, the upper handle portion 70 includes integrated electronics 78 that are in electrical connection with the temperature sensing element 68.

Figure 12:
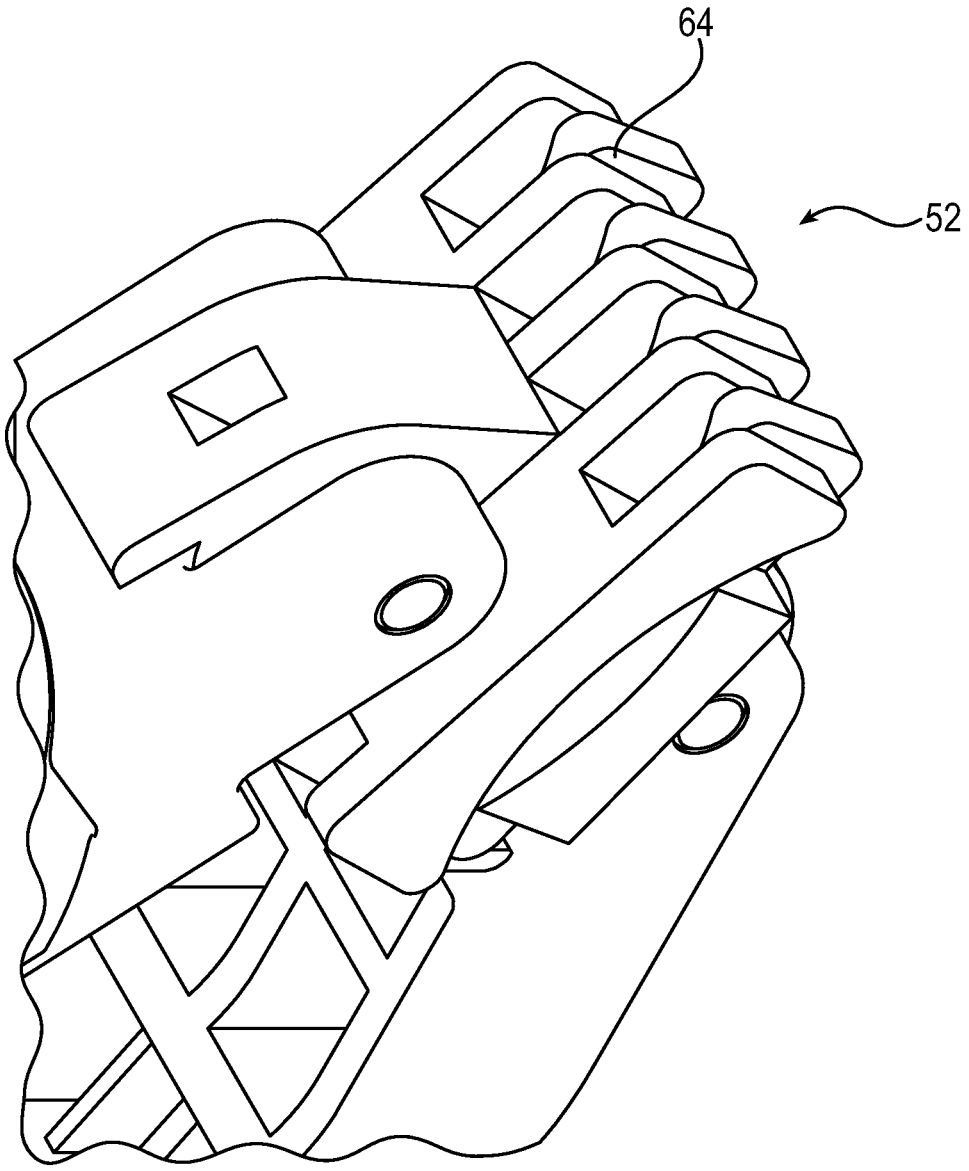
FIG. 12 is a schematic diagram depicting an isometric close-up view of a clamping portion of the temperature sensor clamp, including clamping teeth in the closed position.

As referenced above, FIG. 11 depicts the plurality of clamping teeth 64. FIG. 12 is a schematic diagram depicting an isometric close-up view of the clamping portion 52 of the temperature sensor clamp 50, including the clamping teeth 64 in the closed position. As seen in FIGS. 11 and 12, adjacent clamping teeth interlock in an overlapping configuration when the clamps closes inward. The interlocking and overlapping nature of the clamp teeth permits an increased range of tube size for which the temperature sensor clamp 50 may be employed.

Figure 13:
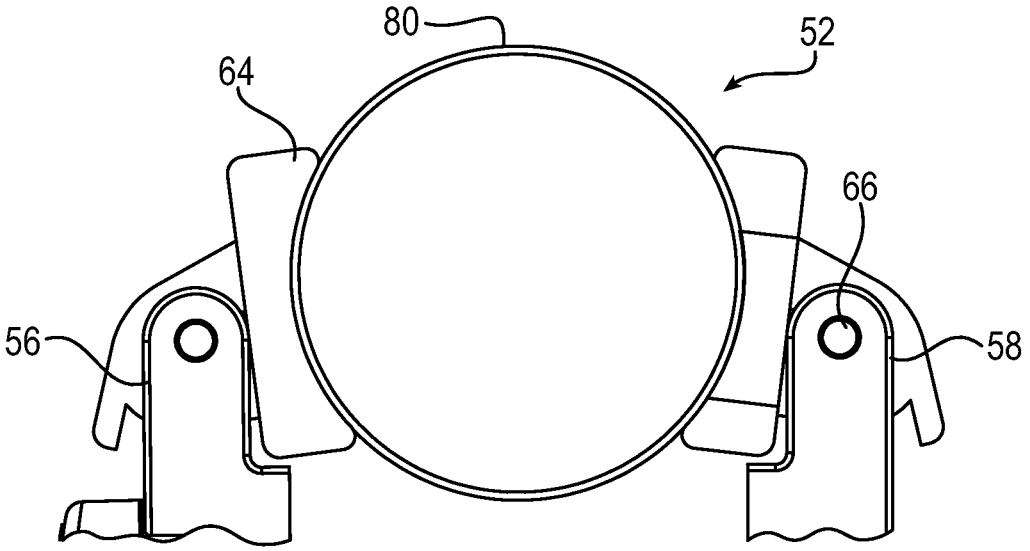
FIG. 13 is a schematic diagram depicting the operation of the clamping portion of the temperature sensor clamp to grip a relatively large diameter tube.
Figure 14:
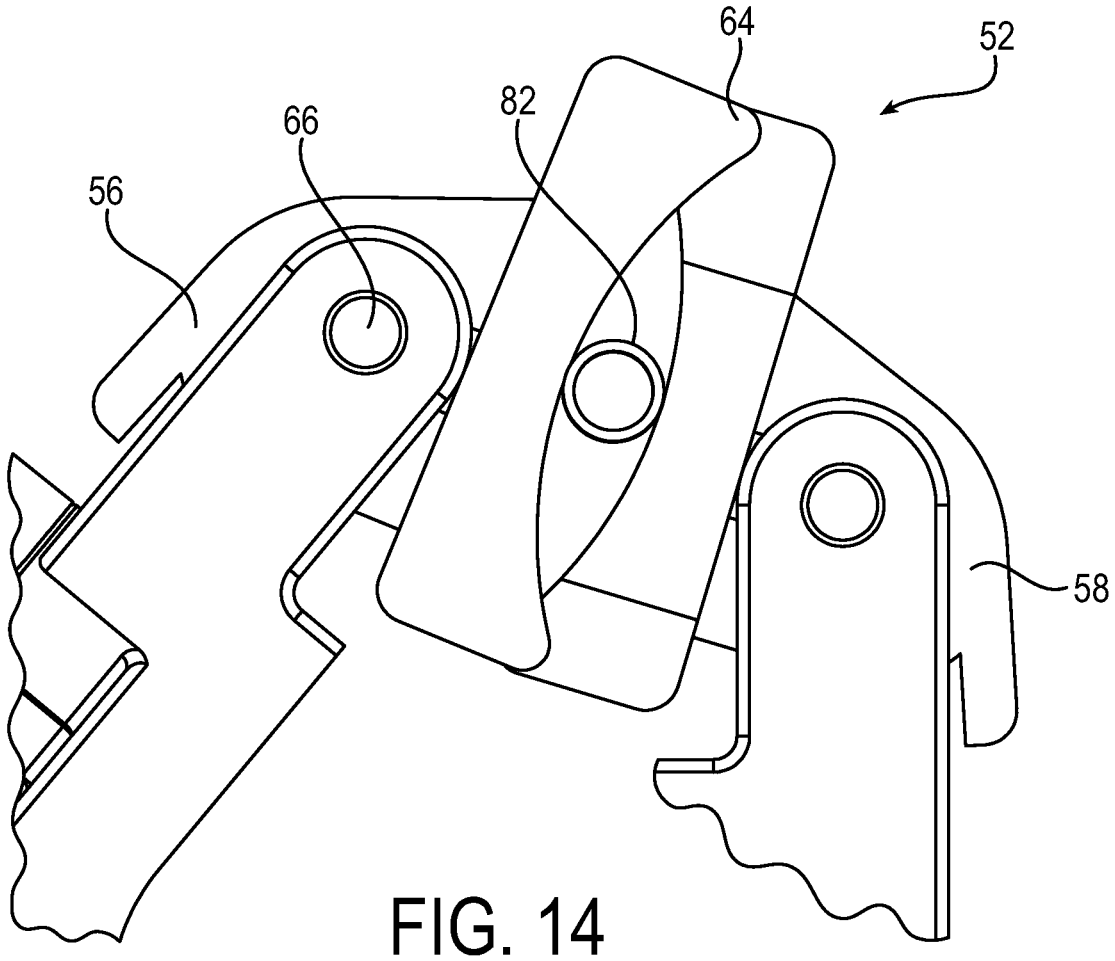
FIG. 14 is a schematic diagram depicting the operation of the clamping portion of the temperature sensor clamp to grip a relatively small diameter tube.

FIGS. 13 and 14 are schematic diagrams depicting the operation of the clamping portion of the temperature sensor clamp for different sized tubes. In particular, FIG. 13 first depicts the operation of the clamping portion to grip a relatively large diameter tube 80. As seen in FIG. 13, the clamping portion is opened to fit the tube diameter, and a relatively wider gripping range may be achieved by outward rotation of the upper and lower clamping tips 56 and 58 about the clamp tip shafts 66.

As the tube size is reduced, the clamping teeth begin to come together until the clamp teeth reach a threshold point at which edges of the clamp teeth essentially meet. As the clamping teeth close further, adjacent clamping teeth interlock in an overlapping configuration when the clamps closes inward beyond the threshold point. Such configuration, for example, is seen in FIGS. 11 and 12 in which the clamping portion is fully closed without gripping any tube. In addition, FIG. 14 depicts the operation of the clamping portion to grip a relatively small diameter tube 82. The tube 82 is of a sufficiently small diameter that the clamping teeth 64 are closed beyond the threshold point, and thus interlock in an overlapping configuration to grip the small-sized tube 82. An enhanced grip further may be achieved by inward rotation of the upper and lower clamping tips 56 and 58 about the clamp tip shafts 66.

The enhanced tip configuration of the present invention provides for gripping an increased range of tube diameters, for example approximately 3/16" to 1½" diameter tubes, although the tip configuration may be made to accommodate any suitable diameter tube. Conventional temperature sensor clamps utilize a flat style jaw that lacks the described interlocking teeth. The conventional flat jaw limits the size of tube diameters, for example to approximately ⅜" to 1⅛". As a result, the configuration of the clamping portion of the present invention permits the technician to service white goods (i.e., small appliances) with small diameter tubes up to large refrigeration or air conditioning chillers with large diameter tubes, a range of usage that is not available with conventional configurations.

The clamping portion of the present invention further includes an integrated perforated gripping portion for gripping the tube of the refrigerant unit. The integrated perforated gripping portion may be configured as a perforated gripping pad to increase the grip of the clamp on the tube. The perforated gripping portion is seen slightly in the various views. FIG. 15A is a schematic diagram depicting an isometric close-up view of the lower clamp tip 58, including a perforated gripping pad 84. Oppositely to the perforated gripping pad 84, a smooth gripping pad 85 is positioned oppositely on the upper clamp tip 56, as seen in FIG. 15B. As also seen in FIG. 15B, the sensing element 68 is incorporated into the upper clamp tip within or under the gripping pad 85. The gripping portion 85 is made smooth (instead of perforated as the gripping pad 84) to provide a better transfer of heat to the sensing element.

The pad material for either of the perforated gripping pad 84 or smooth gripping pad 85 may be, for example, metal, plastic or other similar materials to provide a requisite abrasion against a gripped refrigerant tube. Conventional temperature clamps have smooth or sometimes slightly dimpled pads for contacting the tube. Conventional smooth or dimpled pads often do not adequately hold the temperature sensor clamp to the pipe, and the temperature sensor clamp can slide around or down the tube due to gravity. Such deficiencies are avoided by the configuration of the described integrated perforated gripping portion. The gripping portion has a grating configuration formed by the perforations. When the clamping portion clamps the tube, the grating scores the tube to pre-clean and better grip the tube.

It is known in the art that an optimal position of the clamping portion is to grip the refrigerant tube at approximately 4:00/8:00 opposite clock positions relative to the cross-sectional diameter of the tube. The perforated gripping portion aids in maintaining this optimal grip position. The clamping portion also may include an external marking to aid in aligning at the optimal position, or the program application may indicate a proper orientation when installed for measurement. The proper installation improves the temperature reading by placing the clamp sensing element in the region where vapor exists inside the tube. If the clamp is installed at an improper position or allowed to slide down, the temperature measurement may be skewed due to oil and/or liquid refrigerant in that location of the tube.

A common practice is to pre-clean the tube with a piece of sandpaper or similar material, but this adds time to the measurement operation. The present invention avoids this deficiency. As referenced above, the perforated grating can score the tube to pre-clean the outside of the tube prior to taking a measurement. In typical cases, the tube will be copper; but non-copper tubes also can be pre-cleaned in this manner. Due to environmental effects, the copper tubes develop a protective coating naturally called copper oxide. The tube may also pick up oil and other debris such as dust or dirt, or adhesives that will reduce the thermal conductivity, and hence accuracy, of the temperature sensor clamp. By installing the temperature sensor clamp of the present invention as described, the technician may spin and rotate the clamp around the tube to remove the copper oxide layer and any other contaminants for better heat transfer prior to taking a measurement. This technique will improve temperature reading accuracy.

Figure 16:
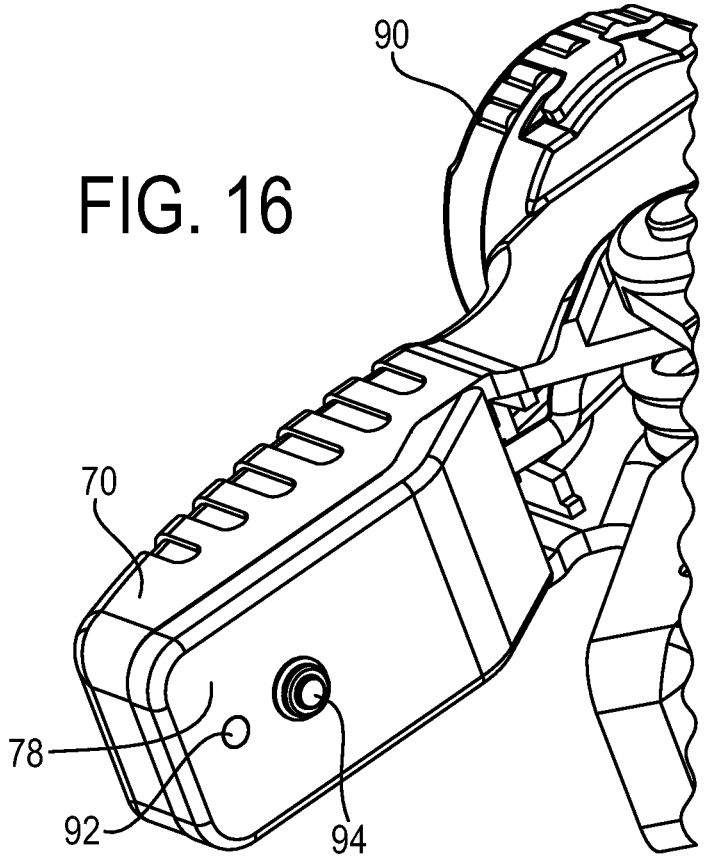
FIG. 16 is a schematic diagram depicting an isometric close-up view of an upper handle portion of the temperature sensor clamp, including integrated electronics.

In exemplary embodiments, as referenced above the temperature sensor clamp further includes integrated electronics, and the integrated electronics are incorporated into the handle and are in electrical connection with the sensor element 68 and a power source. The configuration of the electronics is shown, for example, in FIG. 10. In addition, FIG. 16 is a schematic diagram depicting an isometric close-up view of the upper handle portion of the temperature sensor clamp, including integrated electronics. In particular, the upper handle portion 70 includes integrated electronics 78 that are in electrical connection with the temperature sensing element 68. The integrated electronics may include a power source housing or cover 90 (see also FIG. 11) housing a power source such as, for example, a battery or other power supply, a light emitting indicator 92, and a wireless interface pair button 94. The light emitting indicator may provide status indications for the temperature sensor clamp, such as for example power on/off, ready status, error states, or the like. The wireless interface pair button 94 may aid in pairing the temperature sensor clamp for wireless connection with the portable electronic device 30. The integrated electronics and the sensors may be sealed from environmental elements using any suitable sealing elements. Such sealing may be configured to satisfy any applicable environmental standards for outdoor use or other specified use conditions.

Figure 17:
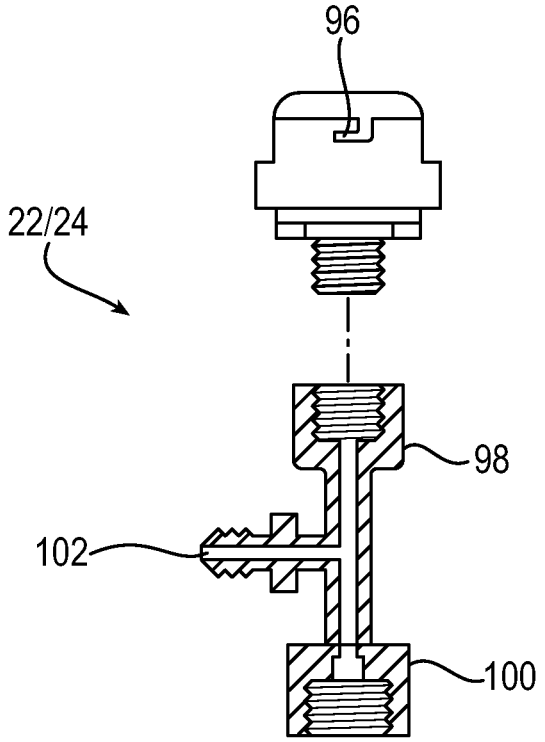
FIG. 17 is a schematic diagram depicting a side cross-sectional view of an exemplary hoseless pressure sensor.

FIG. 17 is a schematic diagram depicting a side cross-sectional view of an exemplary hoseless pressure sensor that may be employed as the first pressure sensor 22 and/or second pressure sensor 24. As seen in FIG. 17, each pressure sensor includes a pressure sensing element 96 that is threaded into a pressure sensor housing 98. The threaded engagement, for example, may be provided by a ⅛" threading. The pressure sensor further may include a flare quick connection 100, such as for example a ¼" SAE connector or other suitable structure, for connection to the refrigerant unit. The pressure sensor further may include an integrated charging port 102, which also may be configured as a ¼" SAE connector or other suitable structure. The integrated charging port allows the technician to add or remove refrigerant, or pull a vacuum on the system without removing the pressure sensor. Such configuration permits the technician to monitor real time conditions as the refrigerant is added or removed.

In accordance with the above description, an aspect of the invention is a sensor system for a refrigerant. In exemplary embodiments, the sensor system includes a plurality of hoseless sensors for sensing system parameters of the refrigerant unit, and a portable electronic device configured to receive the system parameters from the hoseless sensors and to calculate system conditions for the refrigerant based on the system parameters.

In an exemplary embodiment of the sensor system, the plurality of hoseless sensors comprises a hoseless first pressure sensor and a hoseless second pressure sensor, and a hoseless first temperature sensor and a hoseless second temperature sensor.

In an exemplary embodiment of the sensor system, the first pressure sensor and first temperature sensor are sensors for a high side of the refrigerant system, the second pressure sensor and the second temperature sensor are sensors for the low side of the refrigerant system, and the system conditions calculated by the portable electronic device comprise superheat and subcooling for the refrigerant system.

In an exemplary embodiment of the sensor system, the first and second temperature sensors each comprises a temperature sensor clamp having a clamping portion configured to clamp on a tube of the refrigerant unit, the clamping portion including a sensor element to measure temperature about the tube.

In an exemplary embodiment of the sensor system, the clamping portion of each temperature sensor clamp includes a plurality of clamping teeth, and adjacent clamping teeth interlock in an overlapping configuration when the clamps closes inward beyond a threshold point.

In an exemplary embodiment of the sensor system, the clamping portion of each temperature sensor clamp includes a perforated gripping portion for gripping the tube of the refrigerant unit.

In an exemplary embodiment of the sensor system, the gripping portion comprises a grating, wherein when the clamping portion clamps the tube, the grating scores the tube to clean and grip the tube.

In an exemplary embodiment of the sensor system, each temperature sensor clamp further comprises a handle and integrated electronics, and the integrated electronics are incorporated into the handle and in electrical connection with the sensor element.

In an exemplary embodiment of the sensor system, the integrated electronics include at least one of a power source, a light emitting indicator, and a wireless interface pair button.

In an exemplary embodiment of the sensor system, the integrated electronics and the sensors are sealed from environmental elements.

In an exemplary embodiment of the sensor system, each of the first and second pressure sensors comprises a hoseless flare quick connection for connecting the pressure sensors to the refrigerant unit.

In an exemplary embodiment of the sensor system, the first and second pressure sensors further comprise an integrated charging port.

In an exemplary embodiment of the sensor system, the portable electronic device is configured to receive the system parameters from the hoseless sensors over a wireless interface.

In an exemplary embodiment of the sensor system, the portable electronic device includes a communications interface for wirelessly receiving the system parameters from the hoseless sensors, a memory storing a program application for calculating system conditions, and a processor device configured to receive the sensor parameters via the communications interface, and to execute the program application to calculate the system conditions based on the system parameters.

Another aspect of the invention is a temperature sensor clamp for sensing temperature in a refrigerant unit. In exemplary embodiments, the temperature sensor clamp includes a clamping portion configured to clamp on a tube of the refrigerant unit, the clamping portion including a sensor element to measure temperature about the tube, and the clamping portion includes a plurality of clamping teeth, and adjacent clamping teeth interlock in an overlapping configuration when the clamp closes inward beyond a threshold point.

In an exemplary embodiment of the temperature sensor clamp, the clamping portion includes a perforated gripping portion for gripping the tube of the refrigerant unit.

In an exemplary embodiment of the temperature sensor clamp, the gripping portion comprises a grating, wherein when the clamping portion clamps the tube, the grating scores the tube to clean and grip the tube.

In an exemplary embodiment of the temperature sensor clamp, the temperature sensor clamp further comprises a handle and integrated electronics, and the integrated electronics are incorporated into the handle and in electrical connection with the sensor element.

In an exemplary embodiment of the temperature sensor clamp, the integrated electronics include at least one of a battery, a light emitting indicator, and a wireless interface pair button.

Although the invention has been shown and described with respect to certain preferred embodiments, it is understood that equivalents and modifications will occur to others skilled in the art upon the reading and understanding of the specification. The present invention includes all such equivalents and modifications, and is limited only by the scope of the following claims.

What is claimed:

1. A sensor system for a refrigerant unit comprising:

a plurality of sensors for sensing system parameters of the refrigerant unit, wherein:

the plurality of sensors comprises a first pressure sensor and a second pressure sensor, and a first temperature sensor and a second temperature sensor;

the first and second pressure sensors each comprises a connector that connects to a tube of the refrigerant unit;

the first and second temperature sensors each comprises a temperature sensor clamp having a clamping portion configured to clamp on a tube of the refrigerant unit, the clamping portion including a sensor element to measure temperature about the tube;

each of the first temperature sensor clamp and the second temperature sensor clamp further comprises a handle and integrated electronics, and the integrated electronics are incorporated into the handle and in electrical connection with the sensor element; and there are no external physical electrical connections that extend from the first and second temperature sensors, and there are no external physical fluidic connections that extend from the first and second pressure sensors oppositely from the connectors.

2. The sensor system of claim 1, wherein:

the first pressure sensor and first temperature sensor are sensors for a high side of the refrigerant system;

the second pressure sensor and the second temperature sensor are sensors for the low side of the refrigerant system.

3. The sensor system of claim 1, wherein the clamping portion of each of the first temperature sensor clamp and the second temperature sensor clamp includes a plurality of clamping teeth, and adjacent clamping teeth interlock in an overlapping configuration when the clamps closes inward beyond a threshold point.

4. The sensor system of claim 1, wherein the clamping portion of each of the first temperature sensor clamp and the second temperature sensor clamp includes a perforated gripping portion for gripping the tube of the refrigerant unit.

5. The sensor system of claim 4, wherein the gripping portion comprises a grating, wherein when the clamping portion clamps the tube, the grating scores the tube to clean and grip the tube.

6. The sensor system of claim 1, wherein the integrated electronics include at least one of a power source, a light emitting indicator, and a wireless interface pair button.

7. The sensor system of claim 1, wherein the integrated electronics and the plurality of sensors are sealed from environmental elements.

8. The sensor system claim 1, wherein each of the first and second pressure sensors comprises a flare quick connection for connecting the pressure sensors to the refrigerant unit.

9. The sensor system of claim 8, wherein the first and second pressure sensors further comprise an integrated charging port.

10. A temperature sensor clamp for sensing temperature in a refrigerant unit, the temperature sensor clamp comprising:

a clamping portion configured to clamp on a tube of the refrigerant unit, the clamping portion including a sensor element to measure temperature about the tube, and a handle and integrated electronics, and the integrated electronics are incorporated into a portion of the temperature sensor clamp and are in signal communication with the sensor element;

wherein the temperature sensor clamp has no external physical electrical connections.

11. The temperature sensor clamp of claim 10, wherein the clamping portion includes a perforated gripping portion for gripping the tube of the refrigerant unit.

12. The temperature sensor clamp of claim 11, wherein the gripping portion comprises a grating, wherein when the clamping portion clamps the tube, the grating scores the tube to clean and grip the tube.

13. The temperature sensor clamp of claim 10, wherein the integrated electronics include at least one of a battery, a light emitting indicator, and a wireless interface pair button.

14. The temperature sensor clamp of claim 10, wherein the clamping portion includes a plurality of clamping teeth, and adjacent clamping teeth interlock in an overlapping configuration when the clamp closes inward beyond a threshold point.

15. A sensor system for a refrigerant unit comprising:

a plurality of sensors for sensing system parameters of the refrigerant unit; and wherein:

the plurality of sensors comprises a first pressure sensor and a second pressure sensor, and a first temperature sensor and a second temperature sensor;

the first and second pressure sensors each comprises a connector that connects to a tube of the refrigerant unit;

the first and second temperature sensors each comprises a temperature sensor clamp having a clamping portion configured to clamp on a tube of the refrigerant unit, the clamping portion including a sensor element to measure temperature about the tube;

each of the first temperature sensor clamp and the second temperature sensor clamp further comprises a handle and integrated electronics, and the integrated electronics are incorporated into a portion of the temperature sensor clamp and are in signal communication with the sensor element; and there are no external physical electrical connections that extend from the first and second temperature sensors, and there are no external physical fluidic connections that extend from the first and second pressure sensors oppositely from the connectors.

16. The sensor system of claim 15, wherein:

the first pressure sensor and first temperature sensor are sensors for a high side of the refrigerant system;

the second pressure sensor and the second temperature sensor are sensors for the low side of the refrigerant system.

17. The sensor system of claim 15, further comprising a portable electronic device configured to receive the system parameters from the plurality of sensors and to calculate system conditions for the refrigerant based on the system parameters, and there are no external physical connections among the plurality of sensors and the portable electronic device; and wherein the system conditions calculated by the portable electronic device comprise superheat and subcooling for the refrigerant system.

18. The sensor system of claim 17, wherein the portable electronic device is configured to receive the system parameters from the plurality of sensors over a wireless interface.

19. The sensor system of claim 17 wherein the portable electronic device comprises:

a communications interface for wirelessly receiving the system parameters from the plurality of sensors;

a memory storing a program application for calculating system conditions; and a processor device configured to receive the sensor parameters via the communications interface, and to execute the program application to calculate the system conditions based on the system parameters.

20. A sensor system for a refrigerant unit comprising:

a plurality of sensors for sensing system parameters of the refrigerant unit; and a receiving unit that gathers and combines data from at least two of the plurality of sensors;

wherein:

the plurality of sensors comprises a first pressure sensor and a second pressure sensor, and a first temperature sensor and a second temperature sensor;

the first and second temperature sensors each comprises a temperature sensor clamp having a clamping portion configured to clamp on a tube of the refrigerant unit, the clamping portion including a sensor element to measure temperature about the tube;

each of the first temperature sensor clamp and the second temperature sensor clamp further comprises a handle and integrated electronics, and the integrated electronics are incorporated into a portion of the temperature sensor clamp and are in signal communication with the sensor element.

21. The sensor system of claim 20, wherein:

the receiving unit comprises a portable electronic device;

the first pressure sensor senses pressure on a high side of the refrigerant system and the second pressure sensor senses pressure on a low side of the refrigerant system, wherein the first pressure sensor and the second pressure sensor are configured for wirelessly communicating pressure sensor data to the portable electronic device;

the first temperature sensor clamp has a clamping portion with a temperature sensor to measure temperature about a tube located on the high side of the refrigerant system and the second temperature sensor clamp has a clamping portion with a temperature sensor to measure temperature about a tube located on the low side of the refrigerant system; and at least one of the first temperature sensor clamp and the second temperature sensor clamp includes integrated electronics that are configured for wirelessly communicating temperature sensor data to the portable electronic device.

22. The sensor system of claim 21, wherein the first pressure sensor includes a pressure sensor housing having a threaded end for connection to the high side of the refrigerant system, and the second pressure sensor includes a pressure sensor housing having a threaded end for connection to the low side of the refrigerant system.

23. The sensor system of claim 22, wherein the pressure sensor housings include an integrated refrigerant charging port.

24. The sensor system of claim 21, wherein the wireless communication by the pressure sensors and/or the at least one temperature sensor clamp is by Bluetooth communication.

25. The sensor system of claim 21, wherein the integrated electronics in the first temperature sensor clamp is configured for wirelessly communicating sensor data to the portable electronic device and the integrated electronics in the second temperature sensor clamp are configured for wirelessly communicating sensor data to the portable electronic device.

* * * * *